United States Patent [19]

Driver, Jr.

[11] 4,323,012

[45] Apr. 6, 1982

[54] LASER-RESISTANT WARHEAD

[76] Inventor: George J. Driver, Jr., 2416 S. 10th Ave., Caldwell, Id. 83605

[21] Appl. No.: 163,638

[22] Filed: Jun. 27, 1980

[51] Int. Cl.[3] ..... F42B 13/50

[52] U.S. Cl. ..... 102/489; 102/323; 102/465; 102/378; 102/515

[58] Field of Search ..... 102/323, 464, 465, 481, 102/489, 493, 514, 515, 377, 378, 506; 244/117 A, 121, 158 A, 163

[56] References Cited

U.S. PATENT DOCUMENTS

| | | | |
|---|---|---|---|
| 3,465,482 | 9/1969 | Chandler | 244/163 |
| 3,970,006 | 7/1976 | Copeland et al. | 244/117 A |
| 4,041,869 | 8/1977 | San Miguel | 102/481 |
| 4,112,848 | 9/1978 | Lallinger | 102/489 |

OTHER PUBLICATIONS

IBM Technical Disclosure Bulletin, vol. 12, No. 12 5/70 "Laser Beam Absorber", K. J. Dean.

*Primary Examiner*—Peter A. Nelson
*Attorney, Agent, or Firm*—Paul F. Horton

[57] ABSTRACT

A laser-resistant warhead including a missile-carrying housing of graphite composition and an ejectible shell, also of graphite composition, covering the housing. The shell may be ejected either on command or automatically, as determined by heat sensors, for discharge of missiles contained within the housing. The outer surface of the shell may include a reflective, heat insulative, covering for added protection of the system.

8 Claims, 5 Drawing Figures

LASER-RESISTANT WARHEAD

BACKGROUND OF THE INVENTION

1. Field of the Invention

This invention relates, in general, to warheads and, in particular, to warheads having a built-in protection against laser destruction.

2. Description of the Prior Art

Laser weaponry is currently the object of considerable study and research. The destruction of aircraft through laser beams has been reported and similar destruction of missiles can readily be anticipated. There is, therefore, a timely and anticipated need for protecting warheads and any missiles which they may contain from the destructive laser beam.

It is known in the prior art that graphite and numerous compositions of graphite are effective in the dissipation of heat. Such use of graphite is particularly notable in the use of heat shields for the re-entry of space vehicles. As typified by U.S. Pat. No. 4,131,708 issued to Peter Moores, et al; 3,776,139 issued to G. Leomand; and U.S. Pat. No. 3,639,159 issued to E. Rose, et al, graphite compositions have been widely used for rocket nose cones, nozzles, heat shields, and the like, where ability to withstand high temperatures is required.

SUMMARY OF THE INVENTION

The present invention comprises, generally, a warhead including a missile-carrying housing of graphite composition and an ejectible shell covering the housing. The shell is also of graphite composition and may include a reflective coating. A more comprehensive definition of the invention may be found in the appended claims.

It is therefore a general object of the present invention to provide a warhead which is resistant to laser penetration.

It is also an object of the present invention to provide a warhead having an ejectible, laser-resistant, outer shell.

More specifically, it is an object of the present invention to provide a warhead having a missile-carrying housing of graphite composition and an ejectible shell of graphite composition covering the housing.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
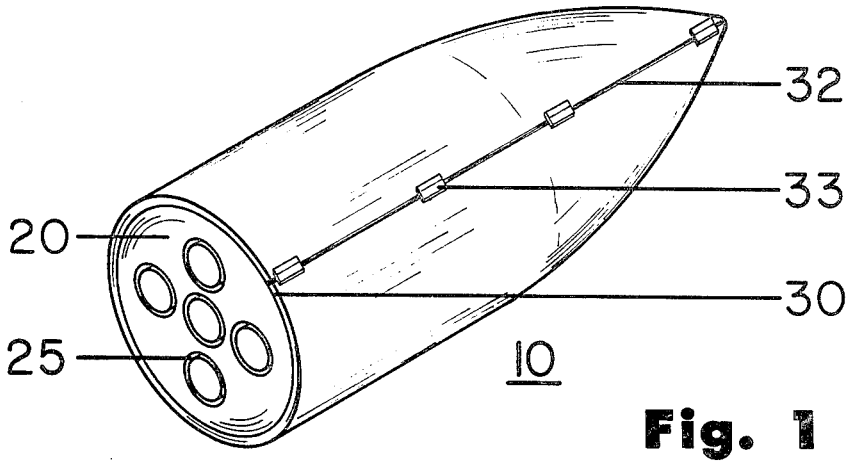
FIG. 1 is a perspective view of the warhead of the present invention.
Figure 2:
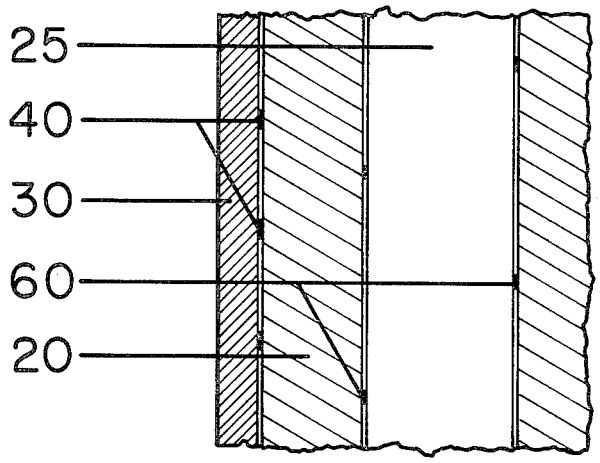
FIG. 2 is a sectional view of a portion of the warhead showing heat sensors.
Figure 3:
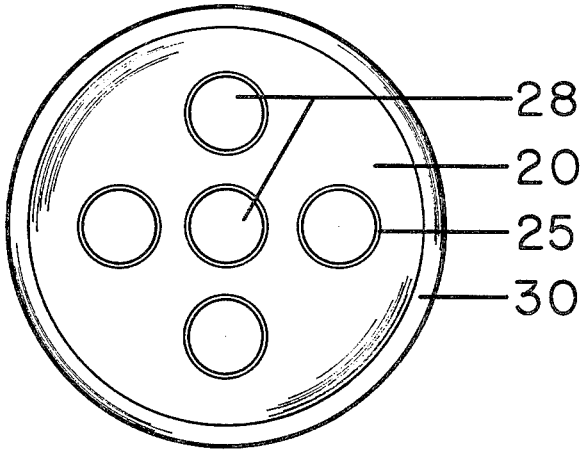
FIG. 3 is a bottom view of the warhead.
Figure 4:
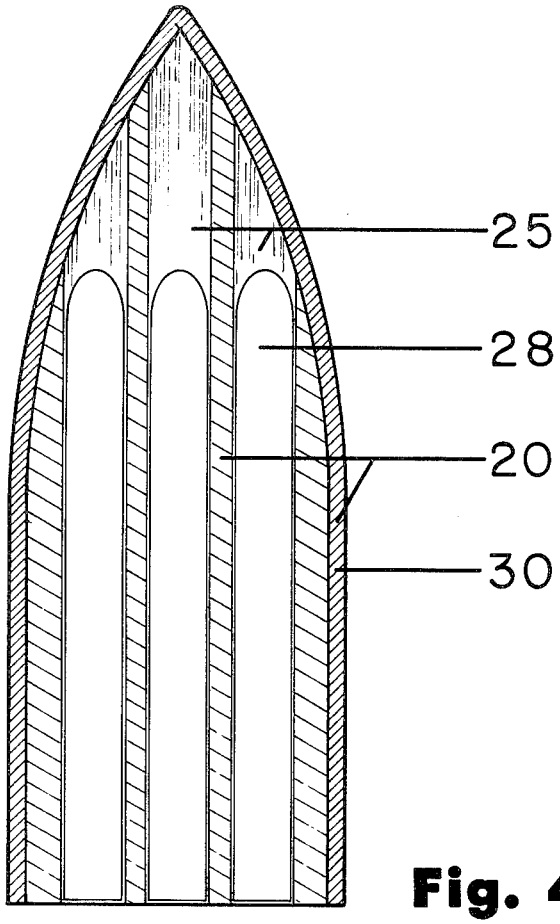
FIG. 4 is a sectional view of the warhead.

Referring now to the drawings, an embodiment to be preferred of the laser-resistive warhead 10 made according to the present invention is disclosed. Warhead 10 includes a housing 20 having one or more firing tubes 25 for holding missiles, a shell 30 covering the housing and heat sensors, designated generally by the numeral 40, operable to automatically control the ejection of shell 30 and missiles 28.

The housing is preferably bullet shaped having a substantially cylindrical body portion and a frustoconical head portion. The housing defines one or more cylindrical tubes 25, each of which are adapted to receive and hold a conventional missile 28. The housing is constructed of graphite composition and preferably a pyrolitic ablative-type graphite composition, conventionally used for space re-entry vehicles. Examples of suitable graphite compositions may be found in U.S. Pat. Nos. 4,131,708 and 3,639,159 issued to Moores and Rose, respectively.

Shell 30 has an external configuration substantially identical to the external configuration of housing 20 and an internal surface adapted to closely accommodate the housing. The shell is constructed of separable portions which are separated either automatically or on command to eject the shell for firing of missiles contained within the housing. The shell may include two identical members hingably engaging one another by means of hinges 32, as may be seen in FIG. 1, and which are held together in encasing the housing by a plurality of conventional explosively dischargeable latches, designated by the numeral 33. Shell 30 is preferably constructed of the same graphite composition as the housing. Shell 30 may be provided with a covering or coating of highly reflective material having low thermal emissivity as, for example, aluminum paint or foil, bonded to the shell. The particular type of reflective material used will be determined by the protection sought. In that thermal emissivity depends upon the wavelength of light striking the reflector, the reflector should be keyed to the laser wavelength expected.

Figure 5:
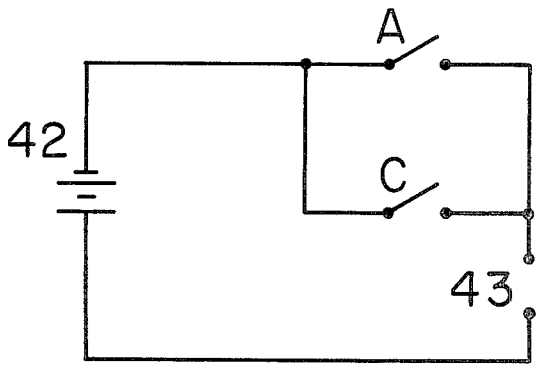
FIG. 5 is a schematic showing circuitry for the automatic and command firing of latches and missiles.

Warhead 10 is preferably provided with a plurality of heat sensors 40 selectively spaced between the housing and the shell. Attachment of the sensor may be either to the interior surface of the shell or the outer surface of the housing. The sensors may be surrounded by a foil of high heat conductance, not shown, for improved sensitivity. Sensors 40 upon sensing a predetermined heat threshold are operable to cause the opening of latches 33 and the subsequent ejection of shell 30. Sensors may be of the bimetallic type, rod and tube type, temperature sensitive resistance element type, or of other conventional types. It is obvious that the sensor-controlled opening of the latches may take many forms. FIG. 5 shows one embodiment whereby the shell may be ejected either automatically, by sensors 40, or by command.

A power source such as battery 42 placed at any suitable location within the housing is connected through parallel switch elements A and C to a spark gap 43 for igniting explosive latches 33. Switch element A may be any of the parallel wired sensors 40 and switch C may represent a switch operable upon command as by ground control, on board computer, or the like. It will be seen then that closure of either switch A or C will cause a spark operable to ignite the explosive latches and eject the shell.

Warhead 10 is also preferably provided with a second set of heat sensors, designated by the numeral 60. Sensors 60 are placed at selected positions on the interior surface of tubes 25 of housing 20. Sensors 60 may also be of conventional type and are operable, at a particular preselected temperature to fire selected missiles 28 held within the tubes of the housing. Electrical circuitry, while not limited to, may be similar to that of FIG. 5. Missiles may be fired either by command, switch C, or automatically, switch A; switch A being any of parallel wired sensors 60. As in the case of sensors 40, the sensitivity of the sensors may be increased by surrounding the sensors with a foil of high heat conductivity.

In operation and assuming the warhead to be in free flight, a laser attack upon the warhead will first be resisted by the highly reflective thermal insulation of the outer covering or coating of the shell. Once there has been penetration of the reflective covering, the graphite of the shell will undergo ablation removing much of the heat. Remaining heat will have a tendency to be evenly distributed over the entirety of shell because of thermal conductivity of graphite compositions. Assuming constant laser bombardment, heat sensors 40 will then reach their threshhold and activate latches 33, blowing the latches and causing ejection of shell 30 as it pivots about conventional hinges 32. The shell will then depart the housing carrying the bulk of the heat with it.

Assuming further laser bombardment, housing 20 itself will undergo ablation with concomitant heat removal. Eventually, sensors 60 will activate missiles 28, firing all or selected missiles thereby preventing missile detonation within the warhead.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A laser-resistant warhead comprising:

a thermal insulative housing including one or more missile holding tubes; and an ejectable outer shell of ablative composition encasing said housing.

2. The apparatus as described in claim 1 wherein said housing is of graphite composition.

3. The apparatus as described in claim 1 wherein said shell is of graphite composition.

4. The apparatus as described in claim 1 wherein said shell is provided with an outer covering of reflective insulation having a low emissivity of heat radiation.

5. The apparatus as described in claim 1 further comprising a plurality of heat sensors located between said shell and said housing and means controllable by said sensors operable to eject said shell.

6. The apparatus as described in claim 1 further comprising a plurality of heat sensors located adjacent the inner surface of each of said missile holding tubes and means controllable by said sensors operable to activate the propulsion system of missiles held within said tubes for discharge of the missiles.

7. A laser-proof warhead comprising:

a cylindrical housing of graphite composition having a frustoconical head portion, said housing provided with one or more substantially cylindrical missile holding tubes;

an ejectible outer shell of graphite composition encasing said housing;

first heat sensing means;

means for ejecting said outer shell controllable by said first heat sensing means;

second heat sensing means; and means for activating the propulsion system of selected missiles held within the holding tubes of said housing, controllable by said second heat sensing means.

8. The apparatus as described in claim 7 wherein said outer shell includes a covering of reflective insulation having a low emissivity of thermal radiation.

* * * * *